US010317182B1

(12) United States Patent
Elalem et al.

(10) Patent No.: US 10,317,182 B1
(45) Date of Patent: Jun. 11, 2019

(54) FOAMED CELLULOID DELAY FUZE

(71) Applicants: Mohamed Elalem, Carteret, NJ (US); Philip Abbate, Long Valley, NJ (US); Vincent Gonsalves, Nazareth, PA (US); Matthew P. Evangelisti, Denville, NJ (US); John W. Grassia, Andover, NJ (US); Steve Kotefski, Bloomingdale, NJ (US); Nikola Kotefski, Bloomingdale, NJ (US); Ming-Wan Young, Basking Ridge, NJ (US); Fei Shen, North Arlington, NJ (US); Chong Peng, Harrison, NJ (US); Linjie Zhu, Livingston, NJ (US); Viral Panchal, Parlin, NJ (US)

(72) Inventors: Mohamed Elalem, Carteret, NJ (US); Philip Abbate, Long Valley, NJ (US); Vincent Gonsalves, Nazareth, PA (US); Matthew P. Evangelisti, Denville, NJ (US); John W. Grassia, Andover, NJ (US); Steve Kotefski, Bloomingdale, NJ (US); Nikola Kotefski, Bloomingdale, NJ (US); Ming-Wan Young, Basking Ridge, NJ (US); Fei Shen, North Arlington, NJ (US); Chong Peng, Harrison, NJ (US); Linjie Zhu, Livingston, NJ (US); Viral Panchal, Parlin, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 336 days.

(21) Appl. No.: 14/656,005

(22) Filed: Mar. 12, 2015

(51) Int. Cl.
*F42C 9/10* (2006.01)
*F42B 27/00* (2006.01)
(Continued)

(52) U.S. Cl.
CPC ..... *F42C 9/10* (2013.01); *F42B 27/00* (2013.01); *F42B 27/08* (2013.01); *F42C 9/14* (2013.01)

(58) Field of Classification Search
CPC ..... F42B 3/10; F42B 3/11; F42B 3/18; F42B 23/24; F42B 27/00; F42B 27/08; F42B 99/00; F42C 15/00; F42C 15/36; F42C 15/44; F42C 19/00; F42C 19/0838; F42C 19/42; F42C 19/46; F42C 99/00; F42C 9/10; F42C 9/14; C06B 23/00; C06B 43/00; C06C 5/00; C06C 5/04; C06C 5/06;
(Continued)

(56) References Cited

U.S. PATENT DOCUMENTS 2,051,331 A * 8/1936 De Bobula ..... F42B 12/204 102/261
2,148,623 A * 2/1939 Hunter ..... F42C 14/02 102/261
(Continued)

*Primary Examiner* — Bret Hayes
(74) *Attorney, Agent, or Firm* — Lisa H. Wang

(57) ABSTRACT

A safety fuze for use in military and commercial applications, includes a fuze body that is attached to a trigger mechanism, an energetic train contained within the fuze body, and a non-energetic fuze delay mixture that is formed in a rod form so that it can dropped inside the fuze body, without modification to the other components of the safety fuze. Preferably, the non-energetic fuze delay mixture is made of foamed celluloid.

11 Claims, 7 Drawing Sheets

(51) Int. Cl.
*F42B 27/08* (2006.01)
*F42C 9/14* (2006.01)

(58) Field of Classification Search
CPC ..... E21B 43/1185; E21B 43/11852; E21B 43/11855; E21B 43/11857
USPC ..... 102/487, 499, 322, 379, 380, 396, 416, 102/424, 200, 202, 202.1, 202.5, 202.6, 102/204, 205, 206, 275.1, 275.3, 275.6, 102/705
See application file for complete search history.

(56) References Cited

U.S. PATENT DOCUMENTS 2,363,234 A * 11/1944 Doll ..... E21B 43/1185 175/4.55
2,773,448 A * 12/1956 Jasse ..... F42B 5/16 102/379
3,128,600 A * 4/1964 Oldham ..... F02K 9/26 60/250
3,823,669 A 7/1974 Zacharin
3,926,122 A 12/1975 Wolterman
4,063,514 A 12/1977 Hadfield
4,167,905 A 9/1979 Kosonocky
4,532,866 A * 8/1985 Lagofun ..... F42C 19/085 102/204
4,730,559 A 3/1988 Brightman
5,196,649 A 3/1993 DiRubbio
5,463,954 A * 11/1995 Blair ..... C06B 45/12 102/202
6,082,267 A 7/2000 Cooper
6,965,542 B1 11/2005 Harrington
8,597,444 B1 * 12/2013 Young ..... C06B 23/002 149/108.4
8,617,328 B1 * 12/2013 Young ..... C06B 25/20 149/100
8,696,838 B1 * 4/2014 Faridi ..... C06B 23/002 149/109.2

* cited by examiner

FOAMED CELLULOID DELAY FUZE

GOVERNMENTAL INTEREST

The invention described herein may be manufactured and used by, or for the Government of the United States for governmental purposes without the payment of any royalties thereon.

FIELD OF THE INVENTION

The present invention relates in general to the field of munitions. More specifically, this invention relates to hand emplaced grenades that are provided with a safety fuze using a non-energetic mixture as a fuze delay composition. The safety fuze may be used in military and commercial applications.

BACKGROUND OF THE INVENTION

Safety is a very important design aspect of a hand grenade (or an explosive) fuze in military and commercial applications. Conventional fuze designs account for a time delay period from initiation, for the detonation to occur, in order to ensure that the grenade is cast outside the explosion hazard area.

To this end, numerous conventional hand grenade fuzes have been proposed, some of which are described in the following publications: U.S. Pat. Nos. 3,823,669; 3,926,122; 4,063,514; 4,167,905; 4,730,559; 5,196,649; 6,082,267; 6,965,542; 7,197,983; and 7,712,419, and Statutory Invention Registration H251, issued Apr. 7, 1987 to Field.

These and other fuze designs propose the use of delay elements that are either mechanically, chemically, electrically, or electro-magnetically operated. However, these conventional designs could present various inherent problems, particularly when used in the field, under adverse and stressful conditions.

More specifically, the grenade delay mixtures constitute major concerns in the armed forces. These concerns arise from the dwell time requirement between the activation of the grenade to the detonation. This time cycle is critical to the function of the grenade as well as to the safety of the soldier.

The issue of delay composition mixtures is a continuous issue in the fabrication of grenades, such as the M67. Numerous conventional hand grenade fuze designs include delay mixtures that use an energetic pyrotechnic mixture, which require complex manufacturing and production capabilities. Additionally, due to the characteristics of the delay mixture, end items can sometimes exhibit inconsistent burn times.

What is therefore needed is a fuze design that addresses the foregoing and other concerns, and that provides a solution thereto. Particularly, the fuze design should address the robustness of the delay mixture via a non-energetic mixture approach. Prior to the advent of the present invention, the need for such a fuze design has heretofore remained unsatisfied.

SUMMARY OF THE INVENTION

The present invention satisfies this need, and describes a safety fuze for hand-emplaced grenades, which uses a non-energetic delay mixture. More specifically, the delay mixture uses foam celluloid in lieu of the conventional delay mix composition, with the other features of the fuze remaining unchanged. The new non-energetic delay mixture provides a more consistent burn rate and a more reliable delay than conventional pyrotechnic delay mixtures.

To this end, the non-energetic delay mixture preferably includes foam celluloid. Foam celluloid is a material developed by the U.S. Army Armament Research, Development, and Engineering Center (ARDEC), and has been proven to provide specific burn rates.

U.S. Pat. No. 8,597,444, which is incorporated herein by reference, describes the composition of the foam celluloid. U.S. Pat. No. 8,696,838, which is also incorporated herein by reference, describes the process of making the foam celluloid.

In a preferred embodiment of the present invention, the consistent burn rate of the foam celluloid (or foamed celluloid material) renders it a preferred candidate for use as a delay mix composition in the safety fuze. This consistent burn rate is a very desirable feature of the delay mix.

Additionally, in the processing of the foam celluloid, a robust process is developed such that the foam celluloid delay mix (or mixture), can prove to be more robust from batch to batch, than the conventional energetic composition delay mixture. As a result, the present foam celluloid delay mixture reduces the manufacturing cost of the fuze delay as well as the production costs associated with end-item assembly.

In addition, the present foam celluloid delay mixture of the safety fuze, provides numerous advantages among which are the following:

- Very low variability in burn time/delay time.
- Relative ease of manufacture and shipment. To this end, the foam celluloid delay mixture is an integral piece that can be assembled by simply dropping it in place within a preformed channel inside the fuze body. The mixture can have varying porosity and density.
- Much safer to use than the conventional energetic composition delay mixtures.
- Easy and safe to store, as it is non-energetic.
- Lower production and assembly costs, and higher safety for assembly line workers.
- Improvements in fabrication. The non-energetic foam celluloid mixture is easier to produce that the conventional energetic mixture.
- Potential for Insensitive Munitions (IM) improvements due to reduced energetic content and lower sensitivity to impact. Bullet and fragment impact is less likely to initiate a foam celluloid delay compared to the conventional energetic delay mixture.

BRIEF DESCRIPTION OF THE DRAWINGS

The above and other features of the present invention and the manner of attaining them, will become apparent, and the invention itself will be best understood, by reference to the following description and the accompanying drawings in which some cross-hatching has been removed for ease of illustration, wherein.

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF PREFERRED EMBODIMENTS

Figure 3:
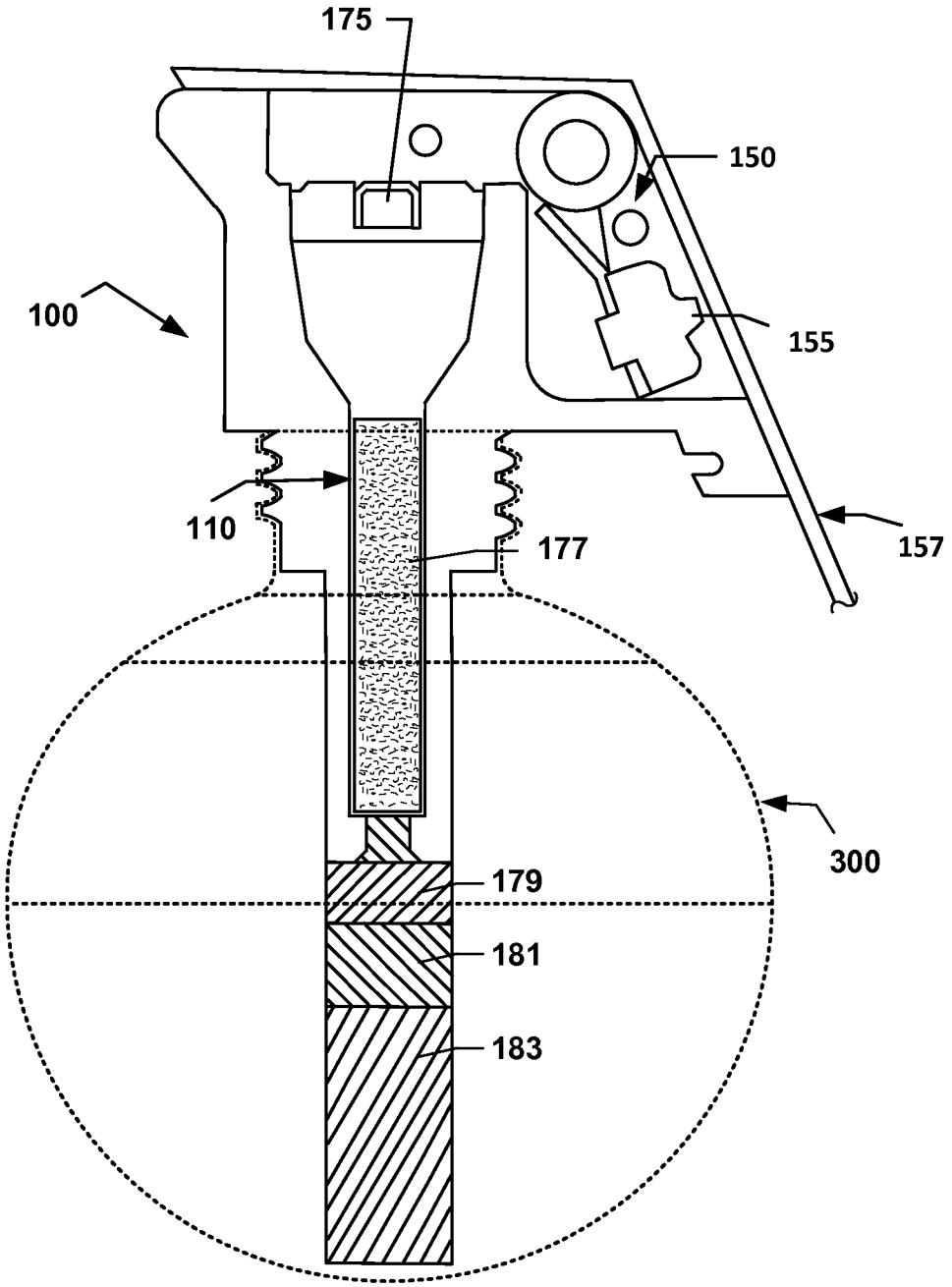
FIG. 3 is a cross-sectional view of a grenade (shown in dotted lines), which is provided with the fuze delay of FIGS. 1 and 2.

A safety fuze 100 of the present invention and its method of assembly and operation will now be described with reference to FIGS. 1 and 3. The safety fuze 100 generally includes a fuze body 110, a trigger mechanism 150, and an energetic train 170.

The fuze body 110 is formed of an upper fuze body 112 and a lower fuze body 114. The upper fuze body 112 is secured to the trigger mechanism 150. In this exemplary embodiment, the trigger mechanism 150 includes a firing pin 155 and a handle 157.

The upper fuze body 112 includes a threaded section 115 that enables a grenade 300 (FIG. 3) or another military or commercial explosive device to be attached to the safety fuze 100. The section 115 is not limited to the illustrated threaded configuration. Rather, it could be shaped to best suit the application for which it is designed.

Depending on the specific application, the design of the safety fuze 100 may require the energetic train 170 to be formed of a plurality of sequential primary and secondary explosives, that are interspaced with one or more delay mixtures of the present invention.

In the present exemplary illustration, the explosive train 170 of the safety fuze 100 generally includes a primer 175 that is disposed within the upper fuze body 112, and a non-energetic delay mixture 177 that is axially disposed within an elongated inner channel 178 of the fuze body 110.

According to a preferred embodiment of the present invention, the non-energetic, foam celluloid fuze delay mixture 177 can be manufactured in either a sheet form or a bead form, as a rod (or column). As a result, during the assembly of the safety fuze 100, the rod containing the foam celluloid fuze delay mixture 177 can be dropped inside the inner channel 178, without further modifications to the safety fuze 100.

In a preferred embodiment, the rod can have various hardness coefficients, to enable its insertion in the inner channel 178. In a preferred embodiment, the rod can be readily handled for insertion in the inner channel 178. In addition, the rod can assume various geometrical profiles, including but not limited to cylindrical, square, rectangular, conical, polygonal profiles.

Below the non-energetic delay mixture 177 a plurality of superimposed layers of explosives or other compositions are formed. In this illustration, the following three layers are used: a lead styphanate layer 179, a lead azide layer 181, and an RDX layer 183. It should be understood that other layers of different compositions may alternatively be used.

In operation, the activation of the firing pin 155 initiates the primer 175, such as when the firing pin 155 is pulled and the handle 157 is released as the grenade 300 is thrown. This event starts the energetic train 170 towards the grenade (300) detonation, as explained below:

A. The firing pin 155 strikes and initiates the primer 175.
B. The primer 175 initiates the non-energetic delay mixture 177.
C. The non-energetic delay mixture 177 provides a 2.5-second dwell prior to initiating the lead styphanate layer 179.
D. In turn, the lead styphanate layer 179 initiates the lead azide layer 181.
E. The lead azide layer 181 initiates the RDX layer 183.
F. The RDX layer 183 initiates the grenade 300.

The utilization of the foam celluloid fuze delay mixture 177 provides a controlled, properly-timed burn in time-delay grenade applications as well as in other military and commercial applications. As an example, the foam celluloid fuze delay mixture 177 can replace the pyrotechnic mixture currently used in grenades (including M67 Frag Grenade and M18 Smoke Grenade).

The foam celluloid fuze delay mixture 177 provides a reliable consistency in burn time/delay time, and increases the soldiers' safety during operations. Additionally, as stated earlier, the foam celluloid fuze delay mixture 177 reduces the overall cost of the fuze delay 100 and the production costs associated with the end-item assembly.

The material properties (e.g., thickness, density, length) of the foam celluloid fuze delay mixture 177 can be varied to accurately and reliably achieve the desired delay times.

In addition, the foam celluloid fuze delay mixture 177 can be manufactured off-site and transported at a relatively low cost. Another advantage of the foam celluloid fuze delay mixture 177 is that the celluloid is non-toxic, safe to handle, HERO safe, and very rugged. By contrast, the conventional energetic pyrotechnic mixtures must be safely pressed and transported to the assembly facility. The manufacturing and shipping costs associated with these conventional energetic pyrotechnic mixtures are high due to the energetic contents.

Figure 1:
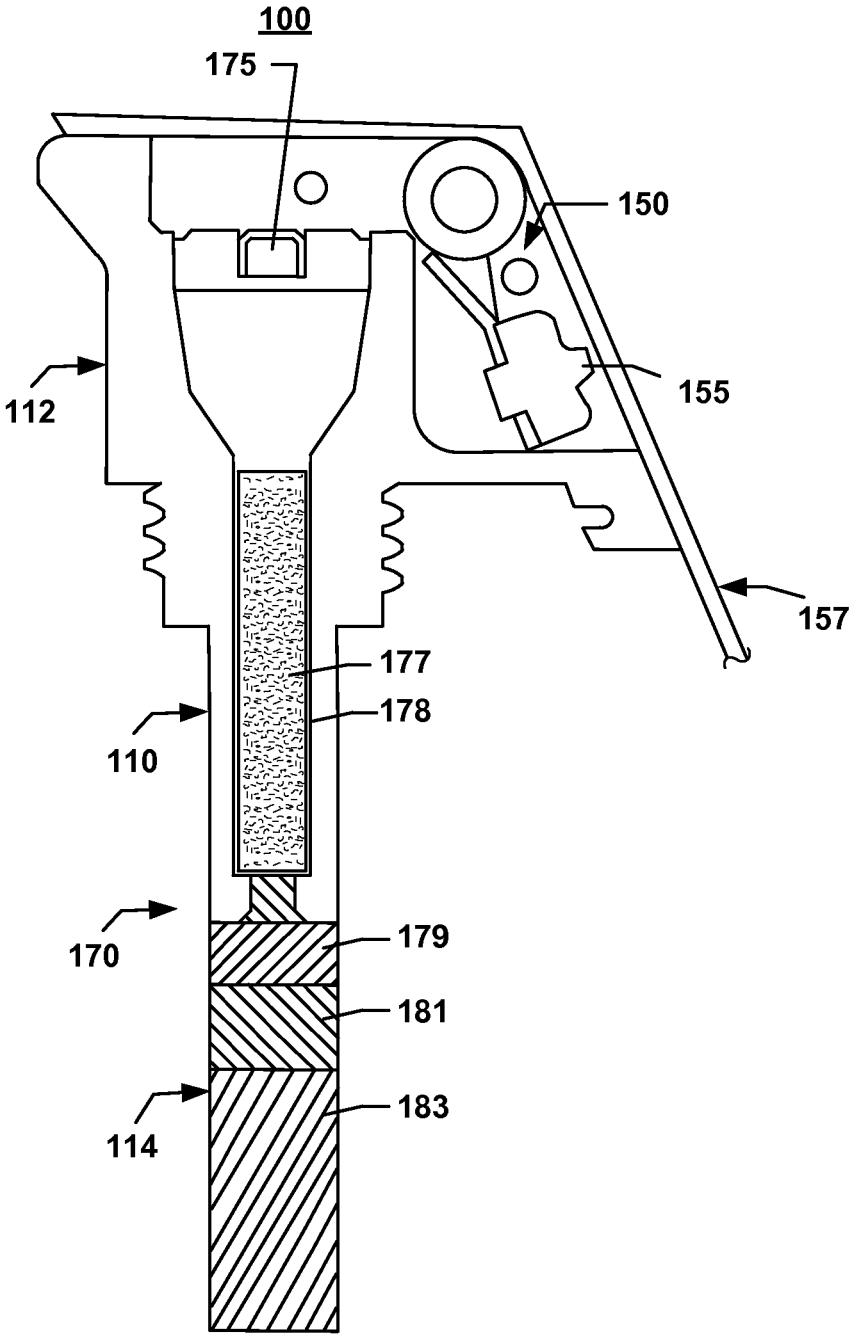
FIG. 1 is a cross-sectional view of an exemplary safety fuze that includes a non-energetic delay mixture according to the present invention, that can be used in military applications, and that can further be modified for use in commercial applications.
Figure 2A:
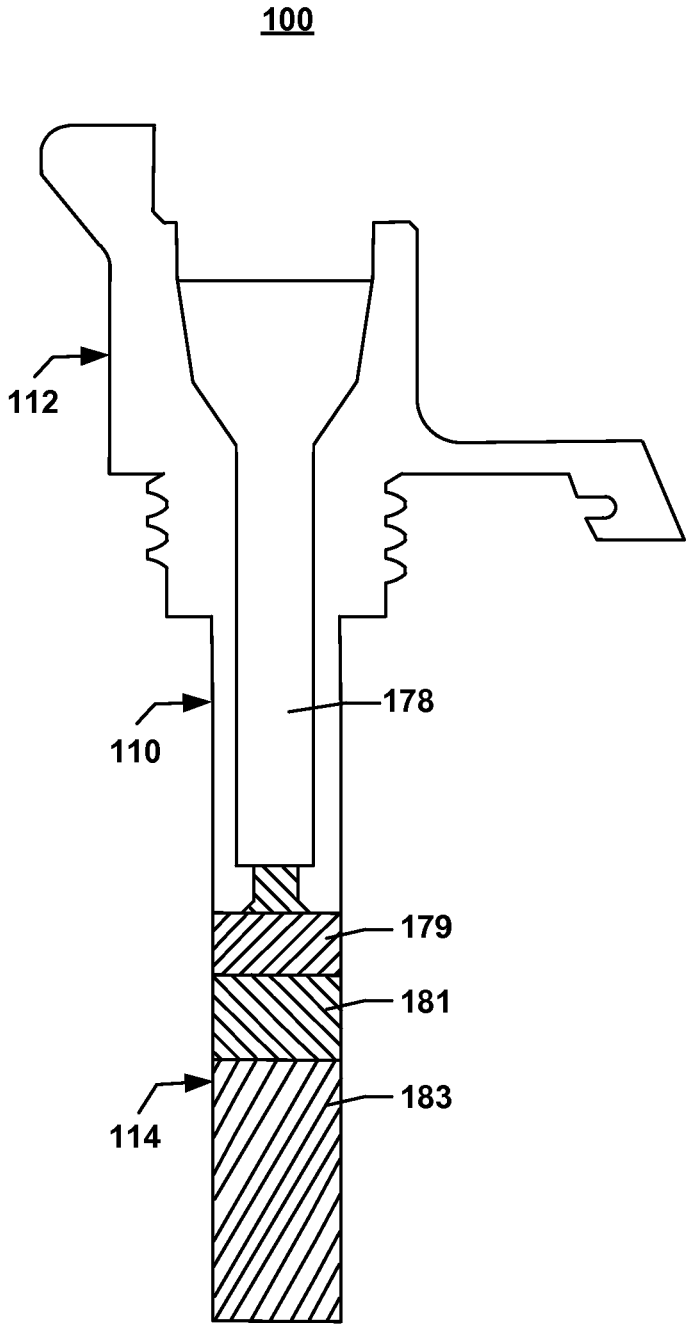
FIG. 2 comprises FIGS. 2A, 2B, and 2C, and illustrates the process of assembling the safety fuze of FIG. 1.
Figure 2B:
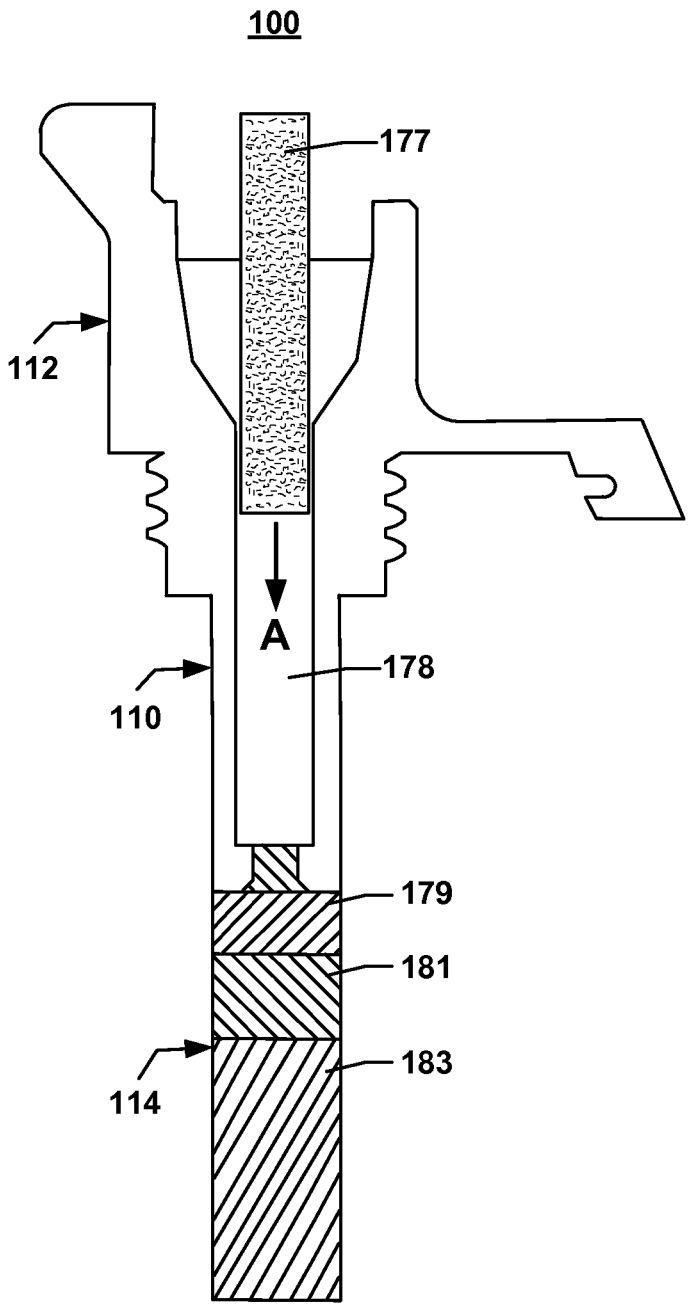
Figure 2C:
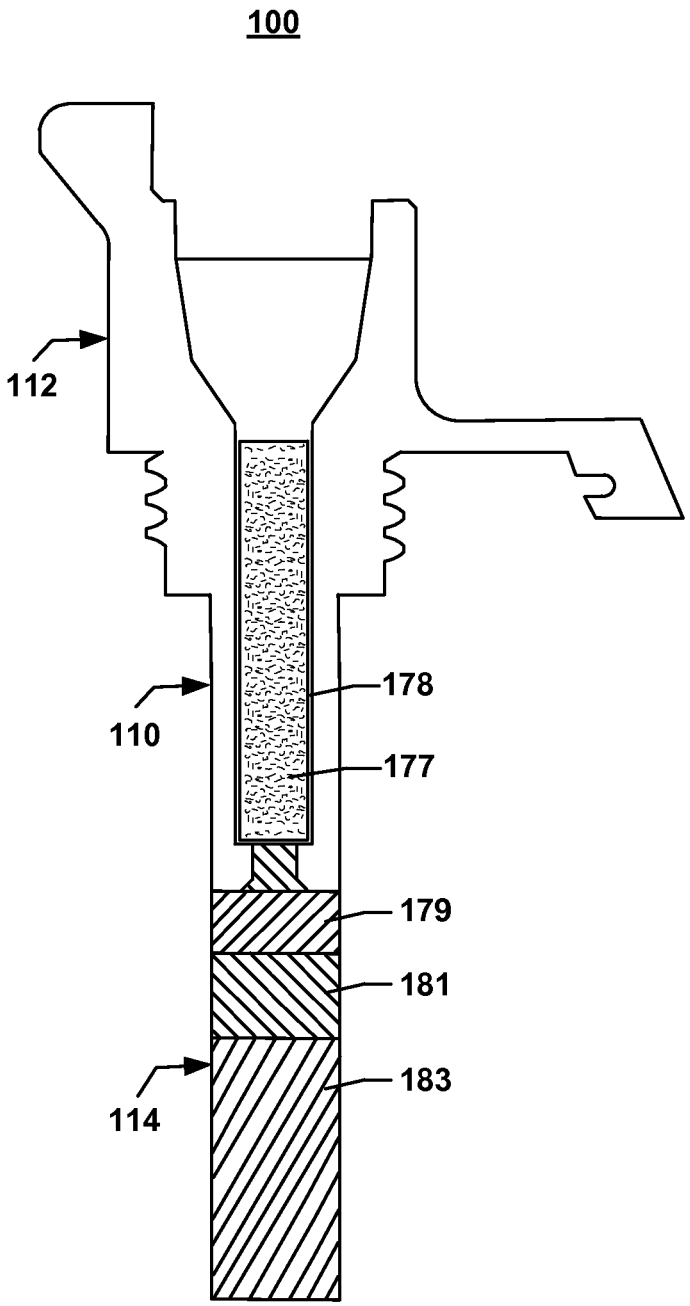

With further reference to FIG. 2 (FIGS. 2A, 2B, 2C), it illustrates the process of assembling the safety fuze 100 of FIG. 1. As shown in FIG. 2A, prior to assembling the trigger mechanism 150, the lead styphanate layer 179, the lead azide layer 181, and the RDX layer 183 are formed within the lower fuze body 114, as is currently known in the art, or will be practiced according to future technological developments.

As further illustrated in FIG. 2B, the rod (or column) of the foam celluloid fuze delay mixture 177 is then inserted (or dropped) inside the inner channel 178 along the arrow A. FIG. 2C illustrates the rod of the foam celluloid fuze delay mixture 177 fully nested within the inner channel 178.

In subsequent steps, the primer 175 and the trigger mechanism 150 are added as is known in the field, to complete the assembly of the delay fuze 100 (FIG. 1).

Figure 4:
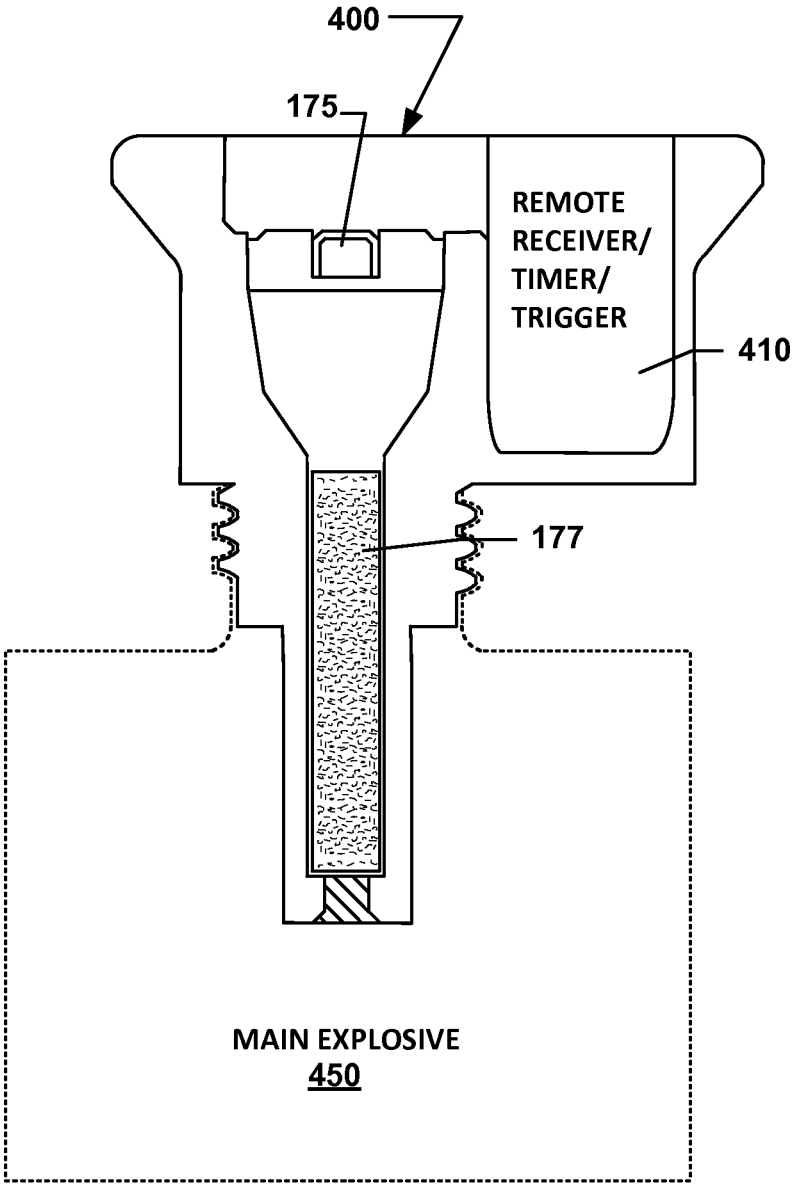
FIG. 4 is a cross-sectional view of a commercial explosive device using a modified safety fuze according to the present invention.

FIG. 4 illustrates the possibility of using the safety fuze of the present invention in commercial applications. In this example, a modified (alternative) safety fuze 400 that is designed for use with a commercial explosive device 450.

The safety fuze 400 is provided with a remote receiver/timer/trigger 410 and a rod of the foam celluloid fuze delay mixture 177, as described earlier. The rod of the foam celluloid fuze delay mixture 177 initiates the explosive device 450 after a predetermined delay.

Figure 5:
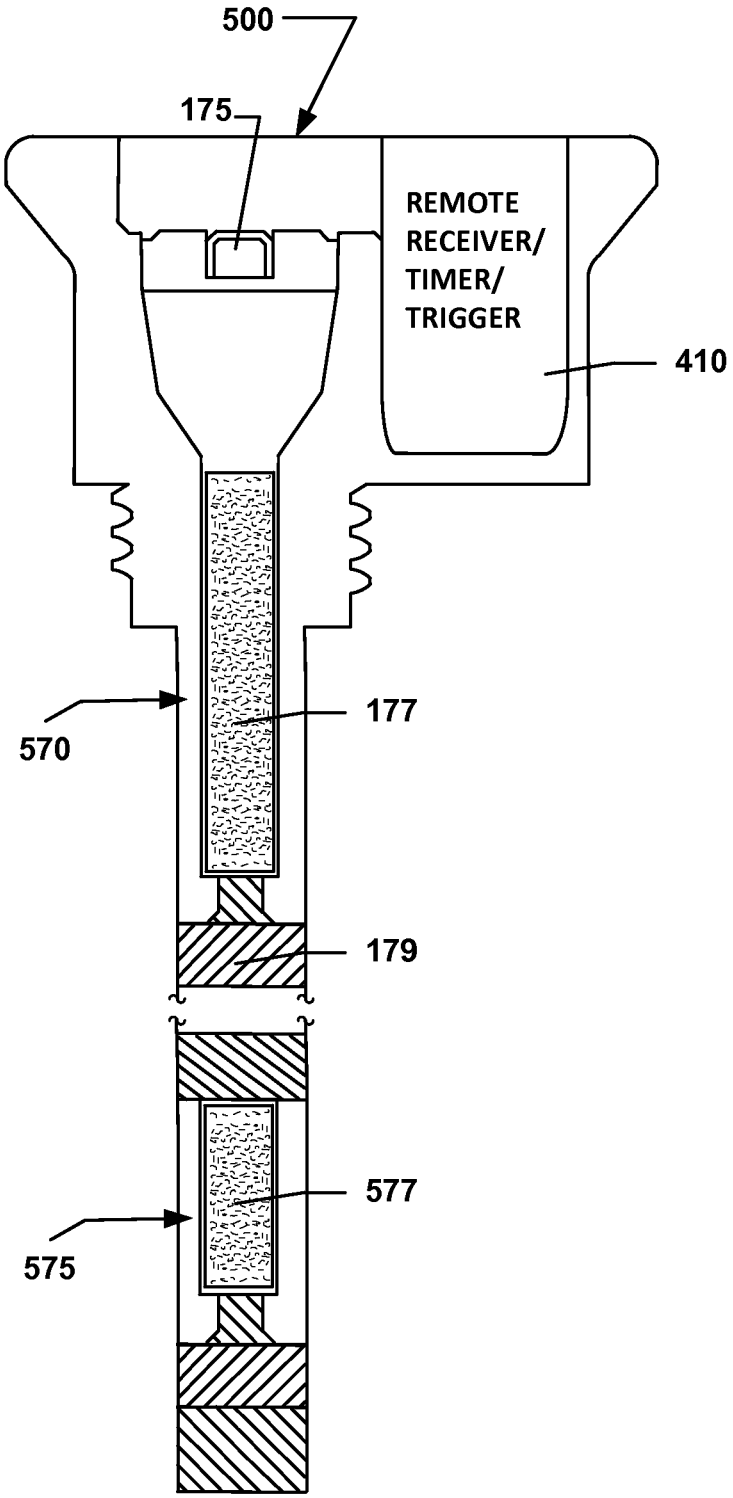
FIG. 5 is a cross-sectional view of yet another embodiment of a safety fuze that embodies successive energetic trains using the non-energetic delay mixture of the present invention.

FIG. 5 illustrates yet another embodiment of a safety fuze 500 that embodies successive energetic trains 570, 575, using the non-energetic rod of the foam celluloid fuze delay mixture 177 of the present invention. This embodiment illustrates the use of multiple delay mixtures within a single application. In addition, this embodiment also illustrates the fact that the rods of the foam celluloid fuze delay mixture 177, 577 have different characteristics, in order to provide different delays, as required by the specific application for which the safety fuze 500 is designed.

While the primer 175 is preferably a percussion device, it should be abundantly clear that the primer 175 illustrated FIG. 5 can be used independently of the trigger mechanism 150 (i.e., without the trigger mechanism 150). As such, the primer 175 can include an electronic trigger mechanism, such as: a bridge wire (e.g., a heated wire) or explosive bridge wires that generate a shock wave, for the purpose of initiating the primer 175. In an alternative embodiment, still independently of the trigger mechanism 150, the primer 175 is heated via thermal methods including without limitations, chemical reactions and laser heating.

It should be emphasized that, although the present safety fuze 100 has been described in connection with one exemplary military application, i.e., a grenade 300, it should be clear that the safety fuze 100 may have multiple commercial applications, including but not limited to: law enforcement, riot control, rescue operations, illumination, pest control, mining, warning means and other lethal and non-lethal applications of munitions such as: grenades, stun grenades, illumination grenades/munitions, percussion grenades and non-lethal warning devices where time delayed reactions are employed.

It is to be understood that the phraseology and terminology used herein with reference to device, mechanism, system, or element orientation (such as, for example, terms like "upper," "lower," "front", "back", "up", "down", "top", "bottom", "forward", "rearward", and the like) are only used to simplify the description of the present invention, and do not alone indicate or imply that the mechanism or element referred to must have a particular orientation. In addition, terms such as "first," "second," and "third," are used herein and in the appended claims for purposes of description and are not intended to indicate or imply relative importance or significance.

It is also to be understood that the invention is not limited in its application to the details of construction and the arrangements of components set forth in the following description or illustrated in the drawings. Other modifications may be made to the present design without departing from the spirit and scope of the invention. As stated earlier, the present invention is capable of other embodiments and of being practiced or of being carried out in various ways, such as, for example, in military and commercial applications.

What is claimed is:

1. A safety fuze comprising:

a trigger mechanism;

a primer, and a non-energetic fuze delay composition initiated by the primer, wherein the non-energetic delay composition is comprised essentially of foam celluloid fully nested in a delay channel.

2. The safety fuze according to claim 1, wherein the non-energetic delay composition comprising foam celluloid is manufactured in a sheet form.

3. The safety fuze according to claim 1, wherein the non-energetic delay composition comprising foam celluloid is manufactured in a bead form.

4. The safety fuze according to claim 1, for use in a device comprising a time delayed reaction.

5. The safety fuze according to claim 1, wherein the trigger mechanism is an initiation trigger mechanism comprising at least one remotely operated component selected from the group consisting of a remotely operated receiver, remotely operated timer and remotely operated trigger.

6. The safety fuze according to claim 1, wherein the non-energetic fuze delay composition comprises a plurality of non-energetic fuze compositions.

7. The safety fuze according to claim 6, wherein the plurality of non-energetic delay compositions comprises a plurality of separate foam celluloid mixtures.

8. The safety fuze according to claim 6, wherein the plurality of non-energetic delay compositions are interspaced between a plurality of energetic trains.

9. The safety fuze according to claim 6, wherein each of the plurality of non-energetic delay compositions provide a similar delay period.

10. The safety fuze according to claim 6, wherein the plurality of non-energetic delay compositions provide different delay periods.

11. The safety fuze according to claim 1, wherein the trigger mechanism generates a shock wave upon initiation.

* * * * *